US009564673B1

(12) United States Patent
Markey

(10) Patent No.: US 9,564,673 B1
(45) Date of Patent: Feb. 7, 2017

(54) ADJUSTABLE IN-BUILDING ANTENNA STRUCTURE

(71) Applicant: FIRST RF Corporation, Boulder, CO (US)

(72) Inventor: Michael R. Markey, Broomfield, CO (US)

(73) Assignee: FIRST RF Corp., Boulder, CO (US)

( * ) Notice: Subject to any disclaimer, the term of this patent is extended or adjusted under 35 U.S.C. 154(b) by 316 days.

(21) Appl. No.: 14/444,510

(22) Filed: Jul. 28, 2014

(51) Int. Cl.
*H01Q 1/12* (2006.01)
*H01Q 1/42* (2006.01)
*H01Q 1/50* (2006.01)

(52) U.S. Cl.
CPC ..... *H01Q 1/1221* (2013.01); *H01Q 1/42* (2013.01); *H01Q 1/50* (2013.01)

(58) Field of Classification Search
CPC .... H01Q 1/007; H01Q 1/1214; H01Q 1/1221; H01Q 1/42; H01Q 1/428; H01Q 1/44
See application file for complete search history.

(56) References Cited

U.S. PATENT DOCUMENTS 2,485,920 A 10/1949 Riblet
5,619,217 A 4/1997 Mailandt et al.
6,249,671 B1 6/2001 Tucker et al.
6,448,930 B1 9/2002 Judd
6,563,465 B2 5/2003 Frecska
6,642,899 B2 11/2003 Strickland et al.
7,039,366 B1 5/2006 McDowell et al.
7,064,725 B2 6/2006 Shtrikman et al.
7,432,858 B2 10/2008 Arndt et al.
2007/0171141 A1* 7/2007 Chan ..... H01Q 1/3275 343/888
2010/0177470 A1* 7/2010 Spivey ..... H01Q 1/1221 361/679.02
2013/0099995 A1 4/2013 Huang et al.
2014/0022131 A1 1/2014 Azulay et al.
2014/0118209 A1 5/2014 Yona

* cited by examiner

*Primary Examiner* — Sue A Purvis
*Assistant Examiner* — Daniel J Munoz
(74) *Attorney, Agent, or Firm* — Christopher J. Kulish

(57) ABSTRACT

An adjustable antenna structure is provided for use inside a building and mounted to an interior structure having a hollow space behind the structure, such as a wall or ceiling. In one embodiment, the antenna structure includes an antenna, a radome with a sleeve and an end surface that extends across one end of the sleeve, a mount that defines an opening for receiving the radome and includes a flange for disposing adjacent to the interior structure, a securing structure with a surface that cooperates with the flange to fix the flange adjacent to the structure, and an adjustment structure for fixing the position of the radome relative to the mount. The adjustment structure can be used to fix the position such that the end surface of the radome is substantially conformal with the flange or the end surface and a substantial portion of the radome extend beyond the flange.

19 Claims, 19 Drawing Sheets

ADJUSTABLE IN-BUILDING ANTENNA STRUCTURE

FIELD OF THE INVENTION

The invention relates to antennas and, more specifically, to an adjustable antenna structure for use inside a building and mounted to an interior building structure, such as a wall or ceiling, that has a hollow space behind the structure.

BACKGROUND OF THE INVENTION

In-building wireless networks have become commonplace. Such networks typically employ multiple antennas distributed around the interior of the building and in a manner that strives to maximize coverage while minimizing the number of antennas. Due to the proliferation of different types of wireless communication systems (e.g., cellular, PCS, and WLAN) and the different frequency bands in which these systems operate, many of the antennas used in in-building wireless networks are designed for broadband operation so as to be able to accommodate as many of the different wireless communication systems as are likely to be used within the building as possible. Further, the antennas employed typically are capable of duplex operation (i.e., can be used to send a wireless signal and receive a wireless signal) and have radiation patterns that endeavor to maximize the coverage within a particular volume of the building.

Many antennas used in in-building wireless networks are associated with an interior building structure (such as a wall or ceiling) that has: (a) a room-side surface which defines at least a portion of the room-space within which the device(s) with which the antenna is to communicate are expected to be located and (b) a plenum-side surface that at least partially defines a hollow and enclosed plenum-space that accommodates an electrical cable (e.g., coaxial cable) that is used to transfer electrical signals to and/or from the antenna. To support such antennas in a desired orientation and location, some form of mounting structure is employed.

Generally, the known antennas and mounting structures that have evolved for use with in-building wireless networks can be categorized into three types. In the first type, the mounting structure engages the interior building structure and supports the antenna such that the antenna extends away from the room-side surface of the structure and into the room-space. Many of this type of in-building antenna and mounting structure employ a radome to cover the antenna and enhance the aesthetic appeal of the antenna and mounting structure. An example of such an in-building antenna and mounting structure can be found in U.S. Pat. No. 6,642,899. The second type of in-building antenna and mounting structure disposes the antenna and the mounting structure entirely within the plenum-space so that neither the antenna nor the mounting structure is visible to anyone in the room-space. An example of this type of antenna and mounting structure can be found in U.S. Pat. No. 7,039,366. The third type of in-building antenna and mounting structure embeds the radiator of the antenna within the interior building structure and embeds or mounts the remainder of the antenna either in the interior building structure or on the plenum-side of the interior building structure. An example of this type of antenna is shown in U.S. Pat. No. 6,563,465, which discloses a ceiling tile antenna with the radiator of the antenna embedded within a ceiling tile, a ground plane for the antenna located on the plenum-side of the ceiling tile, and a portion of the ceiling tile forming the dielectric that extends between the radiator and the ground plane.

SUMMARY OF THE INVENTION

While the known antennas and mounting structures for in-building use function adequately in many instances, it has been determined that these antennas and mounting structures fail to address certain situations. To elaborate, the first type of antennas and mounting structures each have a visual signature that is undesirable in many instances and cannot be remedied. Further, if the performance of the antenna is adversely affected by multi-path effects, the antenna must frequently be relocated to address such effects. The second type of antennas and mounting structures, while eliminating any visual signature, cannot be effectively used with interior building surfaces that are made of metal or incorporate a significant amount of metallic material. Further, this type of antenna and mounting structure typically require relocation of the antenna to address multi-path issues. This type of antenna and mounting structure is also frequently difficult, if not impossible, to locate based solely upon a visual inspection from the room-side of the interior building structure. The third type of antenna and mounting structure also commonly requires relocation to address multi-path issues and can be difficult to locate by visual inspection from the room-side of the interior building structure.

An adjustable antenna and mounting structure, hereinafter occasionally referred to as an adjustable antenna structure or antenna structure, is provided for mounting to an interior building structure such that portion of the antenna structure that is visible from the room-side is substantially conformal with the interior building surface. However, the antenna structure also allows a radome and a radiator supported within the radome to be displaced relative to the interior building structure such that a portion of the antenna structure is no longer substantially conformal with the interior building surface. This flexibility in the positioning of the radome and radiator can be used to adapt the antenna structure to interior building surfaces that are made of metal or incorporate a significant amount of metallic material. Alternatively, the ability to position the radome and radiator in a non-conformal manner can be used to potentially address a multi-path issue that may arise due, for example, to structural changes within the space that the antenna is meant to service, thereby avoiding relocation of the antenna. In addition, the ability to position the radome and radiator in a non-conformal manner provides flexibility as to the desired visual signature of the antenna structure. Namely, when the portion of the antenna structure that is visible from the room-side is substantially conformal with the interior building surface, the antenna structure presents a low visual signature but not necessarily a non-existent visual signature. In contrast, when a portion of the antenna structure is spaced from the interior building surface and no longer substantially conformal with the surface, the antenna structure presents a larger visual signature that may be desirable in certain instances.

In one embodiment, the antenna structure comprises an antenna and a radome that substantially surrounds and supports a radiator associated with the antenna. The structure also includes a mount that comprises a conduit that defines an opening for receiving the radome, a flange that is operatively connected to the conduit, and a securing structure that cooperates with the flange to fix a portion of the interior building structure between itself and the flange and thereby secure the mount to the interior building structure with the flange positioned substantially adjacent to the room-side surface of the interior building structure. The antenna structure further includes an adjustment structure that allows the end surface of the radome to be positioned: (a) substantially conformal with the flange or (b) spaced from the flange. Because the radome supports the radiator, changing the position of the radome also changes the position of the radiator relative to the flange.

In another embodiment, the adjustment structure employs a screw apparatus to allow the end surface of the radome to be positioned at a first position that is substantially conformal with the flange, at a second position that is spaced from the flange, and at substantially any location between the first and second positions.

In another embodiment, the adjustment structure facilitates positioning of the end surface of the radome at a number of discrete locations relative to the flange. Specifically, the adjustment structure allows the end surface of the radome to be positioned at a first discrete position substantially conformal with the flange, at a second discrete position a defined distance from the flange, and at a third discrete position between the first and second positions. In certain embodiments, the adjustment structure allows the radome to be positioned at multiple discrete positions between the first and second discrete positions. The adjustment structure does not allow the end surface of the radome to be positioned at any location that is between two consecutive discrete locations. In a particular embodiment, a bayonet structure is employed to provide discrete positioning. The bayonet structure employs a pin that is associated with the radome and tiered slot that is associated with the mount. To position the end surface of the radome at a discrete position relative to the flange, the pin is positioned in one of the tiered slots.

Also provided is a method for establishing a functional antenna structure within a hole in an interior building structure using an embodiment of the antenna structure described herein. To establish such a functional antenna structure, a hole of appropriate dimension to accommodate and mount the antenna structure is established in the interior building structure, the antenna cable is connected to the antenna, the radome is disposed in the conduit (if not already so disposed), the securing structure is used to fix the mount to the interior building structure, and the adjustment structure is used to position the end surface of the radome at an initial position relative to the flange. With the antenna structure established in the interior building structure, connected so as to be able to send/receive signal, and the end surface of the radome having an initial position relative to the flange, the antenna structure is tested to determine whether the antenna is sufficiently operational within the environment within which the antenna structure is meant to operate. If the antenna is not sufficiently operational, there are at least two possible reasons for the insufficient operation, namely, the presence of multi-path phenomena and/or the interior building structure to which the antenna structure is mounted is made of or incorporates a significant amount of metal. At least these causes of insufficient operation and perhaps other causes can potentially be addressed by repositioning the end surface of the radome and the radiator supported by the radome relative to the flange and, if addressed by such a repositioning, avoid the need to relocate the antenna structure. As such, the adjustment structure is used to establish a different position of the end surface of the radome relative to the flange in an effort to address any such problem. To the extent that the adjustment structure accommodates three or more positions of the end surface of the radome relative to the flange, repositioning and retesting of the operation of the antenna can be repeated two or more times.

A method is also provided for adjusting an embodiment of an antenna structure of the type described herein that has been established in a hole in an interior building structure and is not sufficiently operational. Typically, the antenna structure has previously been sufficiently operational but then fails to operate in a sufficient manner. In many instances, the insufficient operation is potentially attributable to changes in the environment in which the antenna structure is operating. For example, changes in the building structure associated with the space within which the antenna is to operate and/or the location of a device that the antenna structure services within the building can lead to a multipath problem. Another possible environmental change is that interior building structure with which the antenna structure is associated may be replaced or altered such that the antenna structure is disposed substantially adjacent to a metal surface or surface that has a significant metallic content. The method includes having the antenna structure established in a hole associated with an interior building structure, the antenna structure electrically connected to a cable so that electrical signals can be provided to and/or received from the radiator of the antenna, the radome and radiator of the structure are established at an initial position relative to a flange. The method further includes experiencing a situation in which the antenna may not be sufficiently operational and using the adjustment structure to change the position of the end surface of the radome (and the radiator) relative to the flange to address a potential cause of the lack of sufficient operation of the antenna structure.

DETAILED DESCRIPTION

Figure 1A:
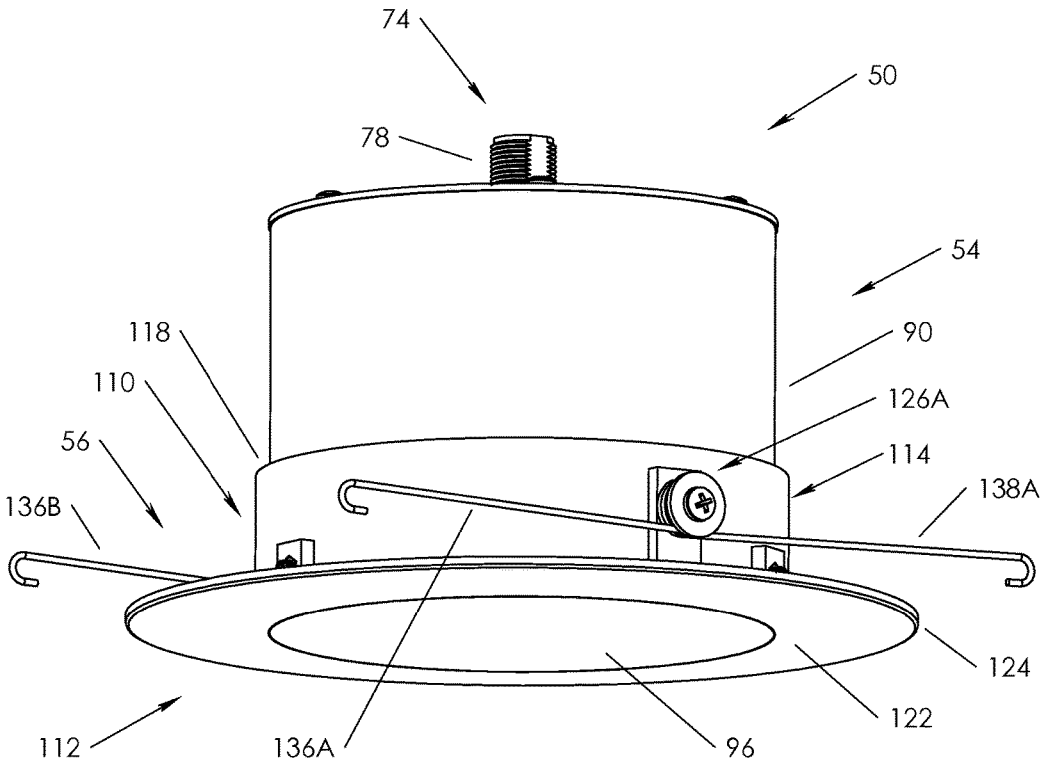
FIG. 1A is a perspective view of a first embodiment of an adjustable in-building antenna structure with an end surface of a radome positioned substantially conformal to the surface of a flange.
Figure 1B:
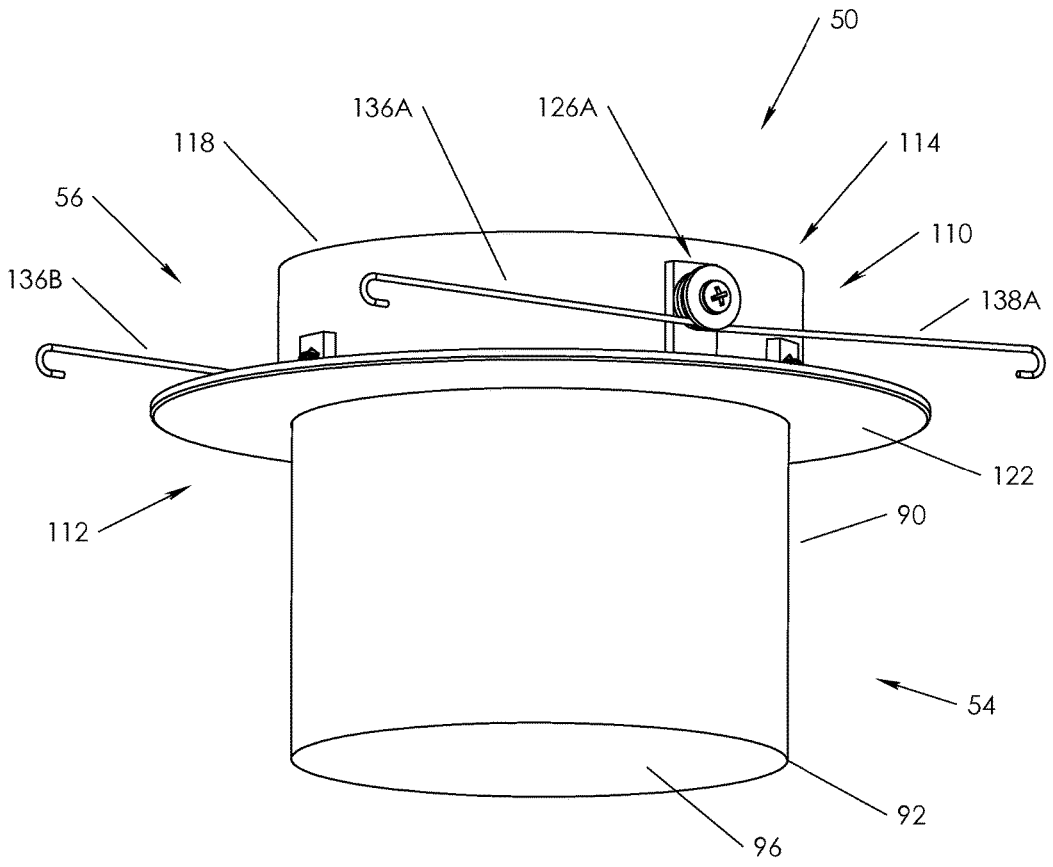
FIG. 1B is a perspective view of the first embodiment of the adjustable in-building antenna structure shown in FIG. 1A with the end surface of the radome spaced from the surface of the flange.
Figure 2A:
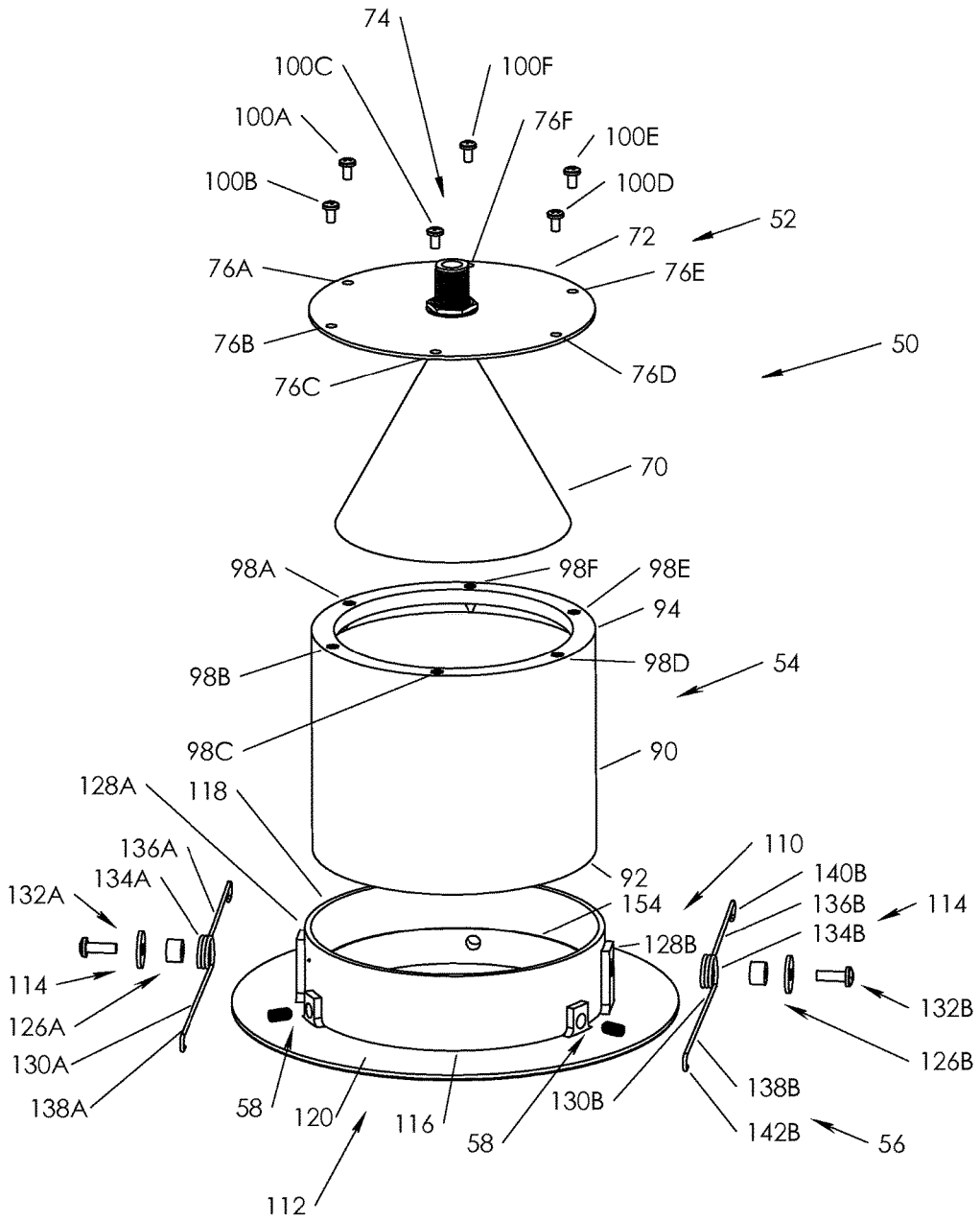
FIGS. 2A and 2B are exploded views of the first embodiment of the adjustable in-building antenna structure shown in FIGS. 1A-1B.
Figure 2B:
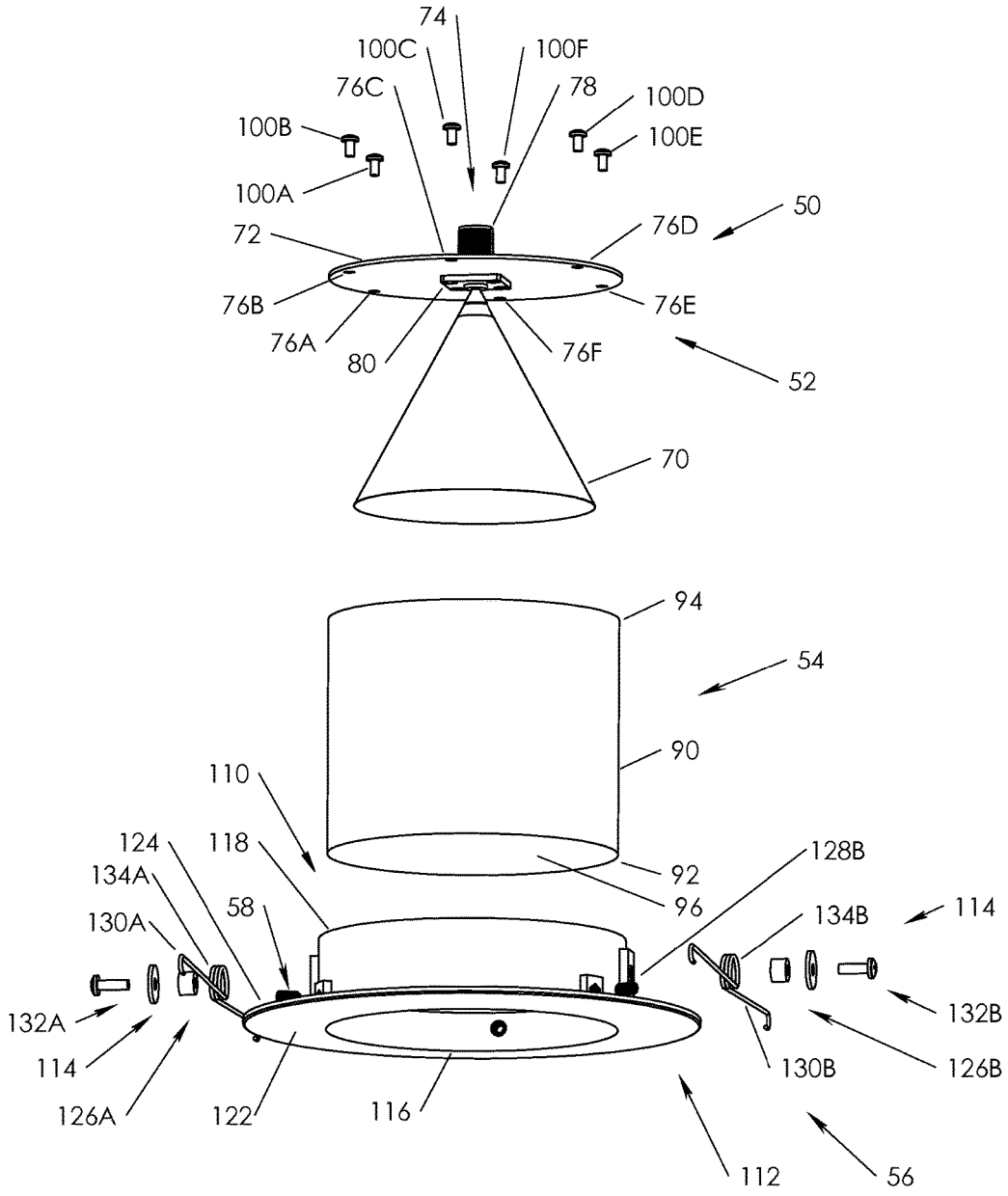
Figure 3A:
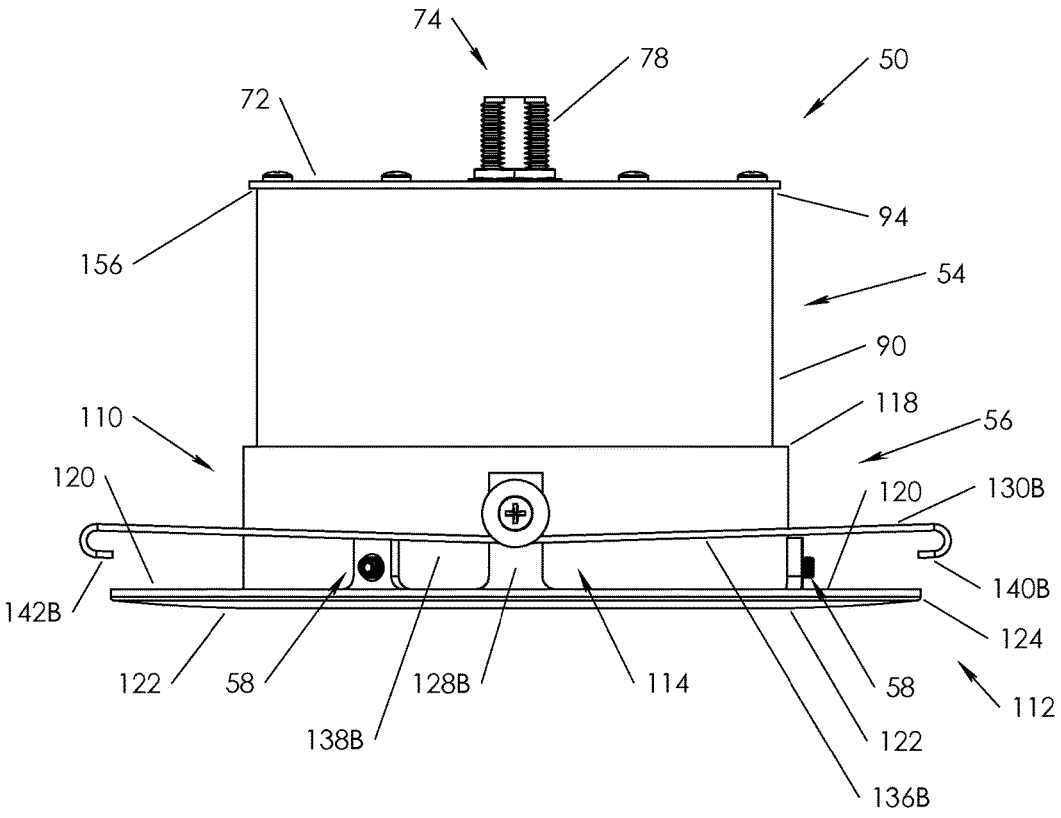
FIGS. 3A-3D respectively are a first side, second side, bottom, and top views of the first embodiment of the adjustable in-building antenna structure shown in FIGS. 1A-1B with the end surface of the radome substantially conformal with the surface of the flange.
Figure 3B:
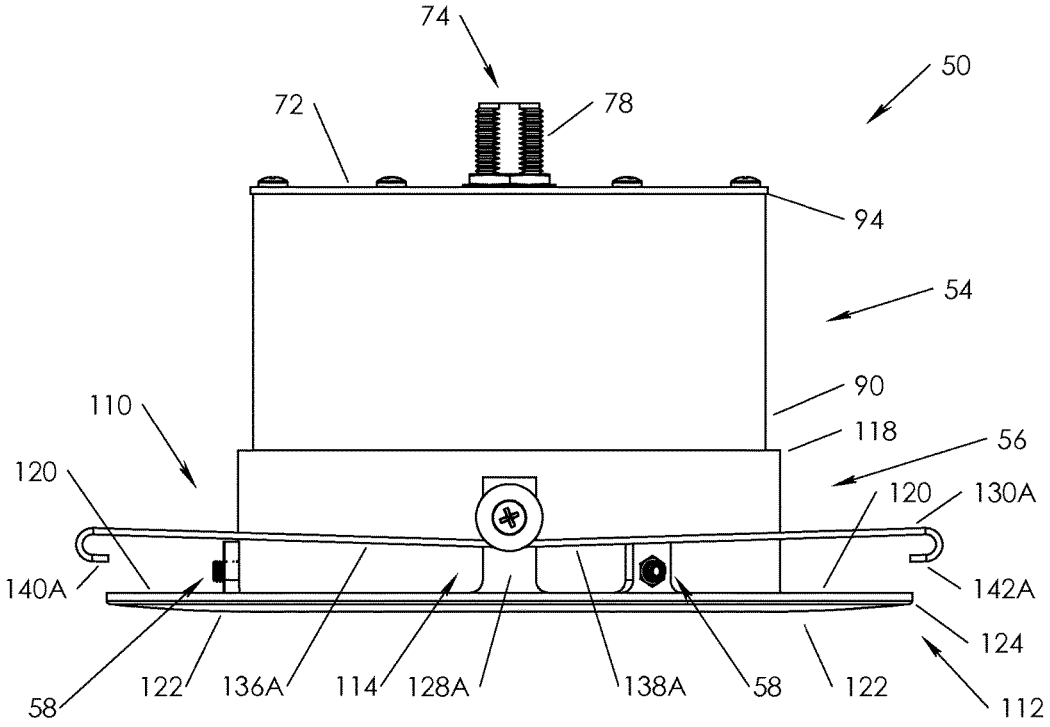
Figure 3C:
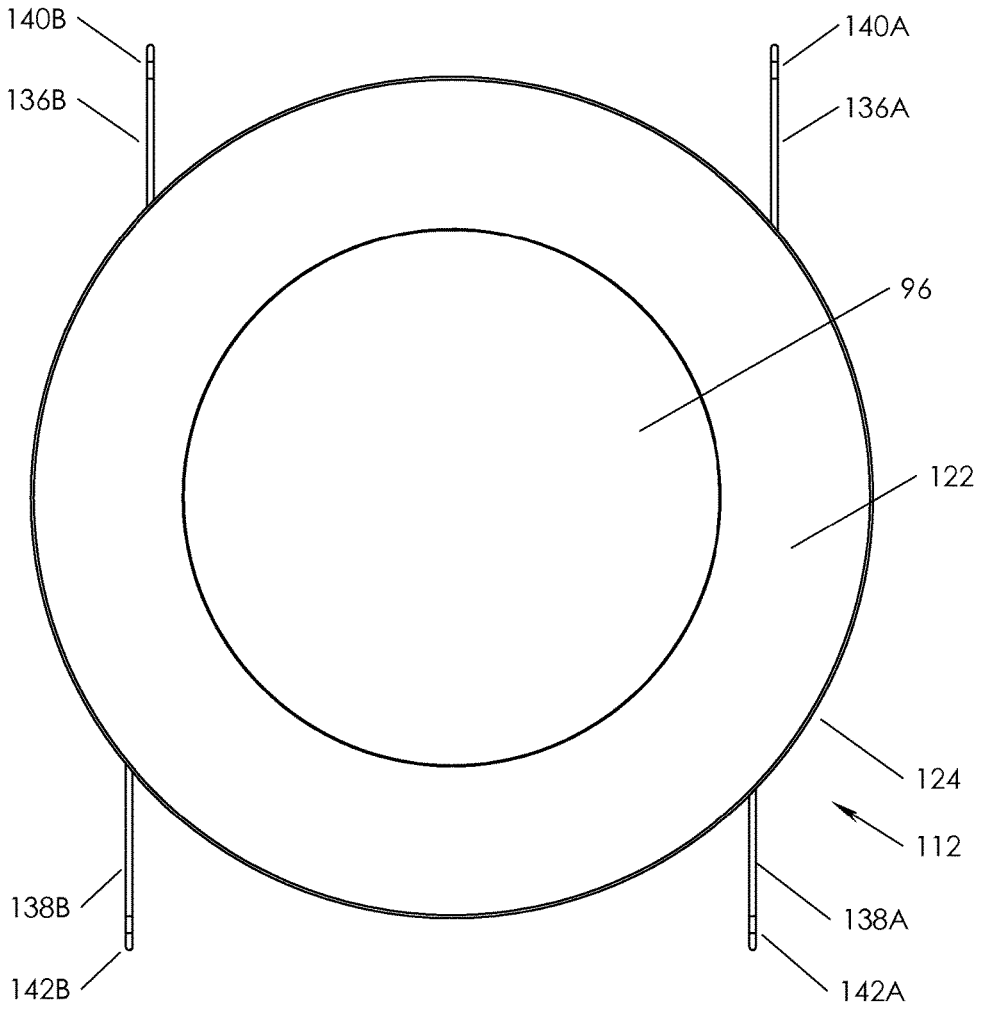
Figure 3D:
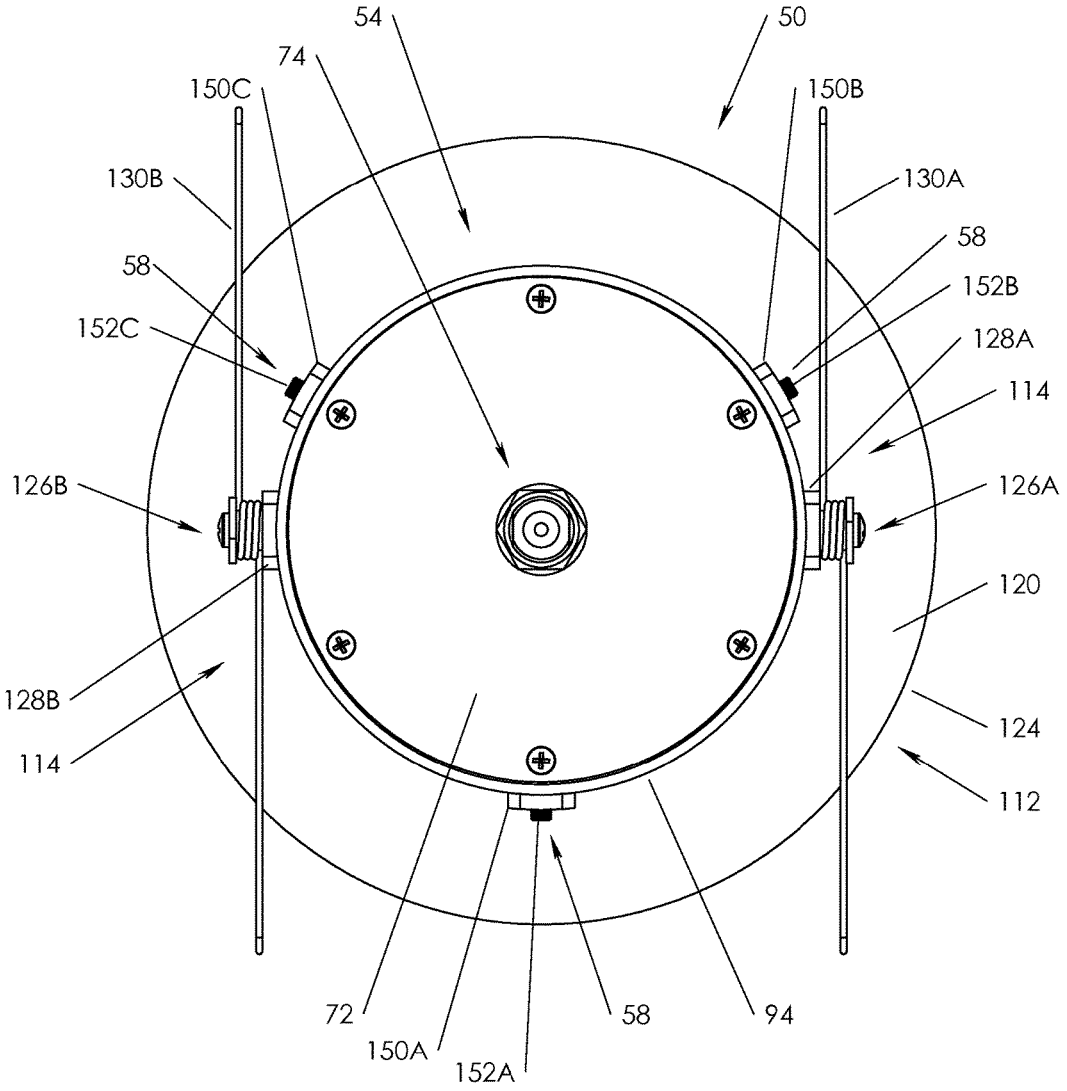

An adjustable antenna structure is provided for use in buildings that allows a radome and the radiator of an antenna that is supported inside of the radome to be positioned such that an end surface of the radome is either conformal with a mounting flange that, in operation is positioned adjacent to an interior building structure, or spaced from the flange. The ability to position that radome/radiator can be used to adjust the visual signature of the antenna structure, compensate for multi-path issues that may affect the operation of the antenna, and/or allow the structure to be used with interior building structures that are made of metal or have a significant metal content.

With reference to FIGS. 1A-1B, 2A-2B, and 3A-3D an embodiment of an adjustable in-building antenna structure 50 (hereinafter "antenna structure 50") is described. Generally, the antenna structure 50 includes a monocone antenna 52, a radome 54, a mount 56, and an adjustment system 58.

The monocone antenna 52 has a bandwidth of 600 MHz to 6 GHz, which allows the antenna to service devices that operate under any of the wireless communication systems presently being used within buildings, including cellular, PCS, and WLAN wireless communication systems. Should the bandwidths of the devices that operate within a building change or only a subset of the wireless operating systems used within a building need to be serviced, the design of the antenna can be altered as is known to those skilled in the art or a different type of antenna be used in place of the monocone antenna as is also known to those skilled in the art. Generally, the type of antenna employed exhibits a hemispherical radiation pattern. The monocone antenna 52 includes a conic radiator 70, a reflector or ground plane 72, and a connector 74. The reflector 72 defines a plurality of holes 76A-76F for receiving screws that are used to attach the antenna 52 to the radome 54. The connector 74 is attached to the reflector 72, has a threaded end 78 for engaging a coaxial cable that is attached to a transmitter and/or receiver when the structure 50 is operational, and a radiator end 80 that engages the conic radiator 70 and the reflector 72. In the illustrated embodiment, the connector 74 is a bulkhead type-N connector. However, it should be appreciated that other types of connector known to those skilled in the art can be employed.

The radome 54 is a hollow, cup-like structure that substantially surrounds and protects the conic radiator 70. The radome 54 is made from a plastic material, which is substantially transparent to electromagnetic signals in the bandwidth of the monocone antenna 52. The radome can be made of other materials known to those skilled in the art (e.g., wood, and fiberglass to name a couple such materials). The radome 54 includes a cylindrical sleeve 90 with a first end 92 and a second end 94. The radome also includes an end member 96 that extends across and closes the first end 92 of the cylindrical sleeve 90. The second end 94 of the cylindrical sleeve 90 defines an opening of sufficient dimension to receive the conic radiator 70. A plurality of bosses 98A-98F, each with a taped hole, are associated with the second end 94 of the cylindrical sleeve 90. A plurality of screws 100A-100F respectively extend through the holes 76A-76F in the reflector 72 and engage the taped holes defined by the bosses 98A-98F to attach the monocone antenna 52 to the radome 54. When the monocone antenna 52 is attached to the radome 54, the end of the monocone antenna 52 is substantially adjacent to the end member 96 of the radome 54 and the reflector 72 closes the second end 94 of the cylindrical sleeve 90 of the radome 54, thereby leading the assembled monocone antenna 52 and radome 54 to have a can-like shape. It should be appreciated that a radome with a cross-sectional shape other than the circular cross-sectional shape of the cylindrical sleeve 92 can be employed, provided the shape defines an interior volume that is capable of accommodating the conic radiator 70 or the radiator of whatever other type of antenna might be utilized. It should also be appreciated that, while the radome 54 is a continuous cup-like structure, a radome with a structure that is a cage-like and cup-like structure that surrounds the radiator of antenna is also feasible.

The mount 56 serves to: (a) engage an interior building structure and (b) support the monocone antenna 52 and radome 54 adjacent to the interior building structure. The mount includes a conduit 110 that defines a cylindrical opening for receiving the radome 54, a flange 112 for positioning adjacent to the room-side surface of an interior building structure, and a securing structure 114 that cooperates with the flange 112 to engage the mount 56 to an interior building structure. The conduit 110 extends from a first end 116 to a second end 118.

The flange 112 extends outward from the first end 116 of the conduit 110 and substantially perpendicular to the longitudinal axis of the conduit 110. The flange 112 has an inner planar surface 120 and an outer planar surface 122 that is substantially parallel to the inner planar surface 120 and separated from the inner planar surface 120 by an edge 124. The distance between the inner planar surface 120 and the outer planar surface 122 is about 4.57 mm prior to the tapering between the two surfaces. In operation, the inner planar surface 120 of the flange is positioned immediately adjacent to the room-side surface of an interior building structure and the outer planar surface 120 is exposed to the interior space that is at least partially defined by the interior building surface.

In the illustrated embodiment, the conduit 110 and flange 112 are a single piece of plastic. The conduit 110 and flange 112 can be separate pieces that are joined together. Further, the conduit 110 and flange 112 can be made of other materials known to those skilled in the art (e.g., wood, fiberglass etc.) and, if the conduit 110 and flange 112 are separate pieces, each made of a different material. Additionally, while the conduit 110 extends substantially perpendicular to the plane of the 112, the conduit 110 can be adapted to extend from the plane of the flange 112 at an angle other than 90°. Such an adaptation may be needed, for example, to accommodate a structure on the plenum-side of the interior building structure. Such a change would potentially necessitate changing the shape of the conic radiator 70 from a right circular cone to an oblique circular cone.

Additionally, while the flange 112 and the end member 96 of the radome 54 are adapted to allow the flange and end member to be substantially conformal with a flat room-side surface of an interior building structure, the flange 112 and end member 96 can adapted to be conformal with curved room-side surfaces, including but not limited to cylindrical-like surfaces, concave surfaces, and convex surfaces.

The securing structure 114 includes a pair of torsion spring assemblies 126A, 126B. The torsion spring assembly 126A includes a boss 128A that defines a threaded hole, a torsion spring 130A, and a screw-washer-spacer assembly 132A for attaching the torsion spring 130A to the boss 128A. The torsion spring 130A includes a coiled portion 134A that is connected to a first arm 136A and a second arm 138A. The first and second arms 136A, 138A respectively have securing surfaces 140A, 142A that, in operation, engage the plenum-side surface of the interior building structure. The torsion spring assembly 126B includes the same elements as the torsion assembly 126A and these elements are identified by the same reference numbers as used with the torsion spring assembly 126A but have a "B" suffix instead of an "A" suffix. In operation, the first and second arms of the torsion springs 130A, 130B are folded upward for insertion of the mount 56 into a hole established in the interior building structure from the room-side. After the mount 56 is inserted into the hole, the potential energy stored in the springs 130A, 130B for insertion of the mount into the hole is released and the arms of the torsion springs 130A, 130B attempt to return to the positions shown in FIG. 1 and in so doing causes opposing normal forces to be applied by the securing surfaces of the torsion springs 130A, 130B and the flange that fix the mount to the interior building structure. The springs 130A, 130B allow the mount to be adapted to interior building structures that have different thicknesses, i.e., different distances between the room-side and plenum-side surfaces of the structure. It should be appreciate that the mount can be adapted to use other devices for securing the mount to an interior building structure, including (a) screws that extend through the flange and engage the interior building structure, (b) toggle bolts that extend through the flange and engage the interior building structure, and (c) structures limited to use with an interior building structure having a particular thickness.

The adjustment system 58 accommodates positioning the radome 54 and the monocone antenna 52 supported by the radome at two extreme positions and at any point in-between the two extremes. The first of the two extremes is characterized by the end member 96 of the radome 54 being substantially conformal with the outer planar surface 122 of the flange 112. In the illustrated embodiment, the end member 96 of the radome 96 can be positioned between the first and second ends 116, 118 of the conduit 110. However, any such positioning of the end member 96 is likely to be aesthetically undesirable and potentially adversely affect the operation of the monocone antenna 52. The second of the two extremes is determined by a hardstop structure that limits the extent to which the radome 54 can extend outward from the flange 112 on the room-side.

The adjustment structure 58 includes bosses 150A-150C that each define a tapped hole that extends from the outside of the radome 54 to the interior of the radome. The tapped holes associated with the bosses 150A-150C respectively receive set screws 152A-152C. The set screws 152A-152C are each tipped with the Teflon® coated tip that allows the tip to engage the exterior surface of the radome 54 to facilitate holding the radome at a desired position relative to the flange 112 without appreciably damaging the exterior surface of the radome. The adjustment structure 58 also includes a shoulder 154 located in the interior of the conduit 110 and a lip 156 of the reflector/ground plane 72 that extends slightly beyond the circumference of the conduit 110 at the second end 118. The engagement of the lip 156 to the shoulder 154 determines the greatest extent to which the radome 54 can extend away from the flange 112 on the room-side (i.e., the second of the two extremes), regardless of whether or not one or more of the set screws 152A are engaging the exterior surface of the radome 54. Additionally, when the lip 156 engages the shoulder 154, the radome 54 is prevented from falling out of the mount 56, which is particularly useful when the antenna structure 50 is mounted in a ceiling. The set screws 152A-152C can be used to further fix the position of the radome 54 relative to the flange 112 at this second extreme. The set screws 152A-152C also allow the position of the radome 54 to be fixed at any position between the second extreme and the first extreme and at the first extreme.

Figure 6A:
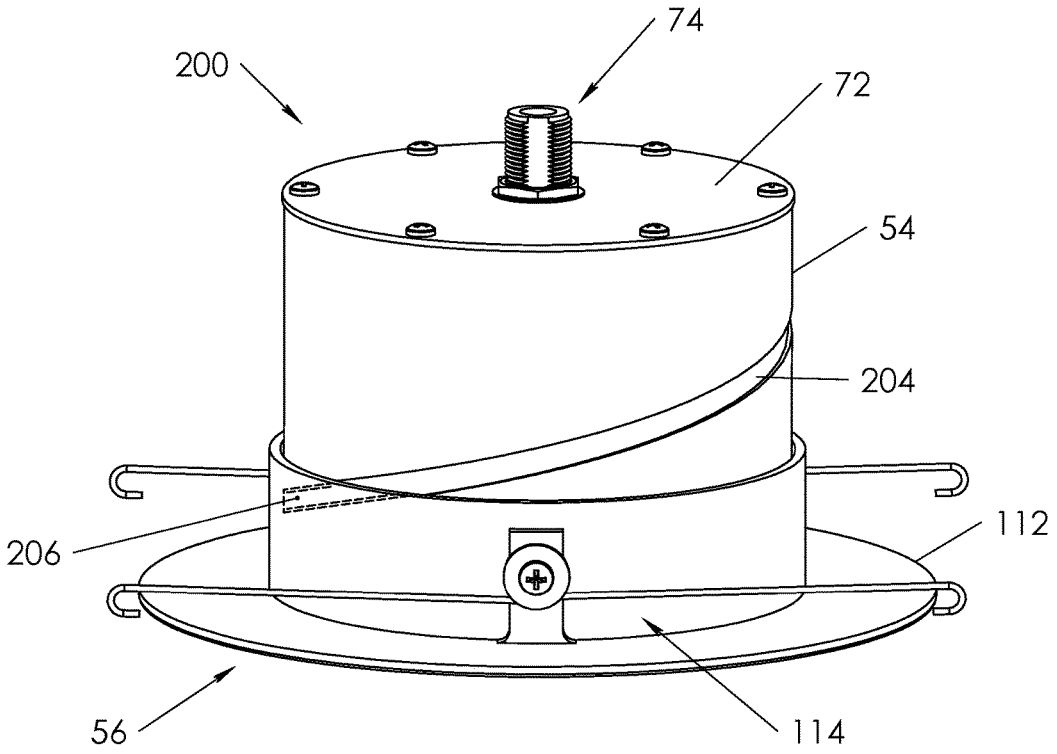
FIGS. 6A-6C respectively illustrate a second embodiment of an adjustable in-building antenna structure with a screw adjustment system that allows the position of the radome to be adjusted such that the end surface of the radome is positioned at: (a) a first extreme characterized by the end surface being substantially conformal to the a flange, (b) a second extreme characterized by the end surface being spaced from the flange, and (c) at any location between the two extremes.
Figure 6B:
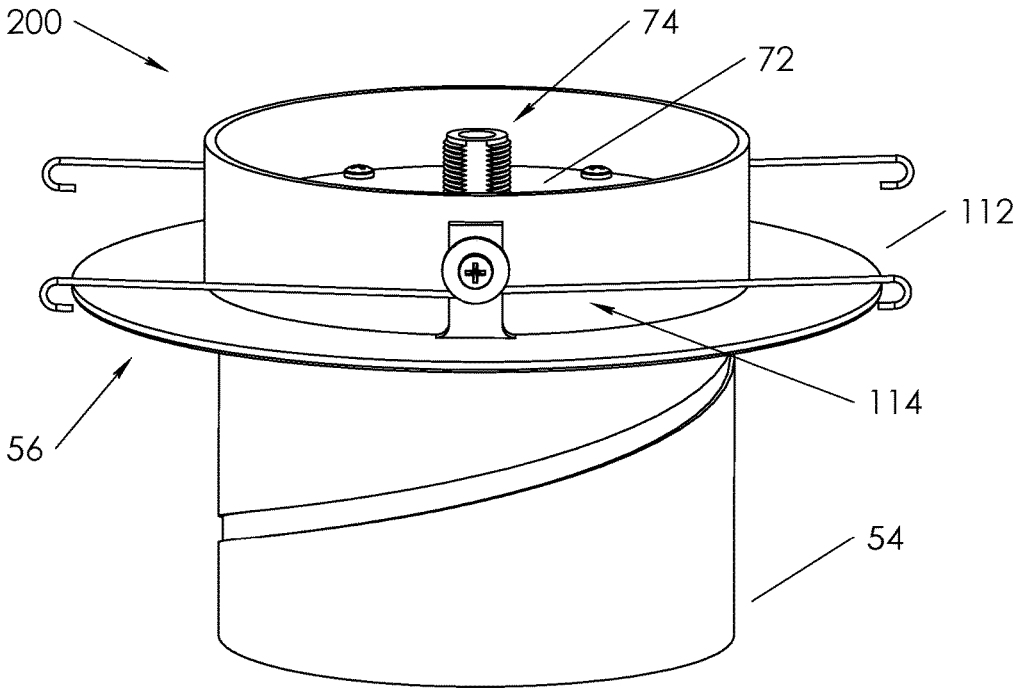
Figure 6C:
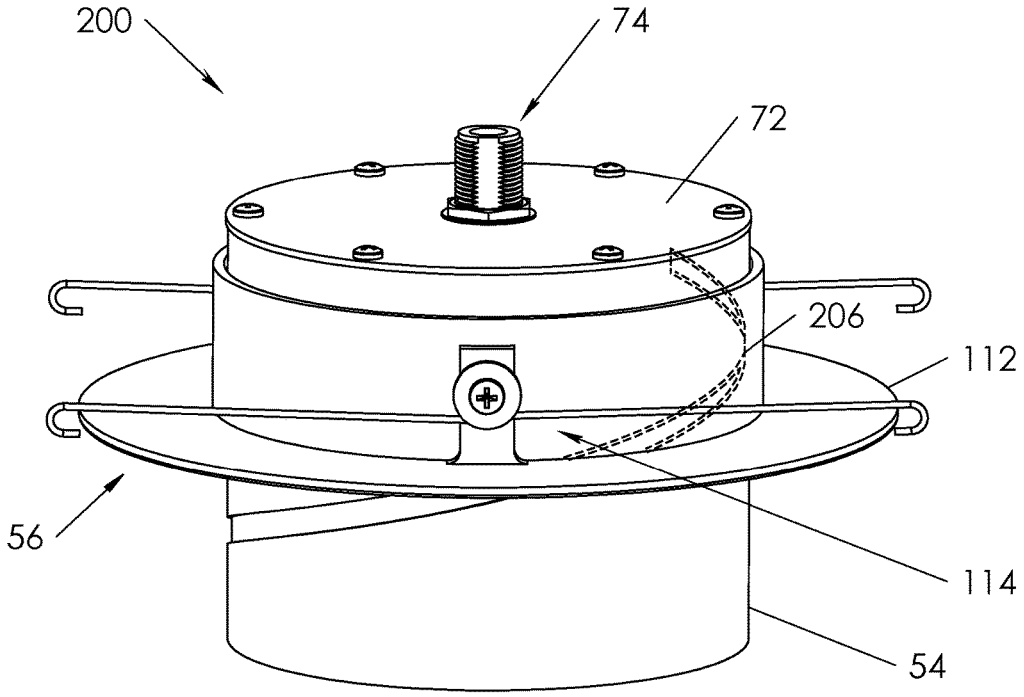

With reference to FIGS. 6A-6C, a second embodiment of an adjustable in-building antenna structure 200 (hereinafter "antenna structure 200") that allows the radome 54 and antenna 52 to be positioned at the two extremes and at any position between the two extremes is described. The antenna structure 200 is substantially identical with the antenna structure 50 with the exception of the adjustment structure. The antenna structure 200 includes an adjustment structure 202 in the form of a screw with a female thread 204 associated with the exterior of the radome 54 and a male thread 206 associated with the interior of the conduit 110. These threads can be reversed with the male thread associated with the exterior of the radome 54 and the female thread associated with the interior of the conduit 110. The adjustment structure 202 facilitates adjustment of the location of the radome 54 relative to the flange 112 from the room-side.

Figure 7A:
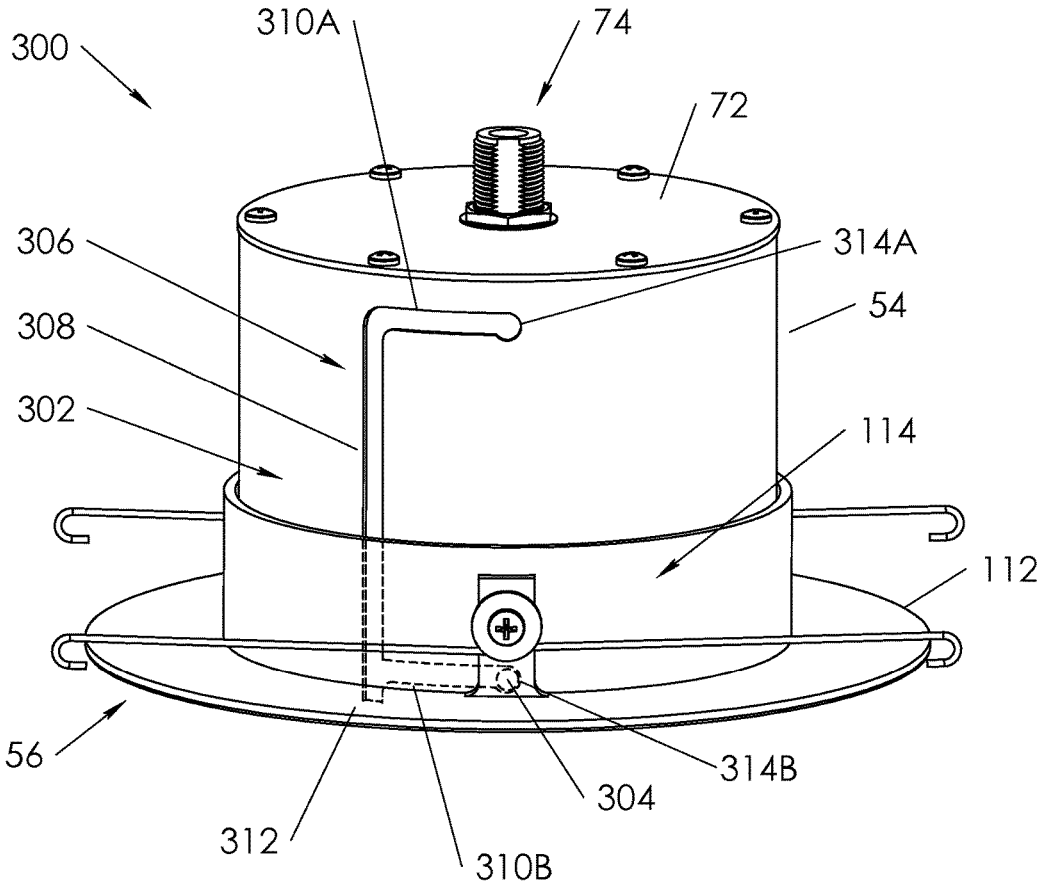
FIGS. 7A-7B respectively illustrate a third embodiment of an adjustable in-building antenna system with a bayonet adjustment system that allows the position of the radome to be adjusted such that the end surface of the radome is positioned at two discrete locations, namely, at: (a) a first extreme characterized by the end surface being substantially conformal to the a flange and (b) a second extreme characterized by the end surface being spaced from the flange.
Figure 7B:
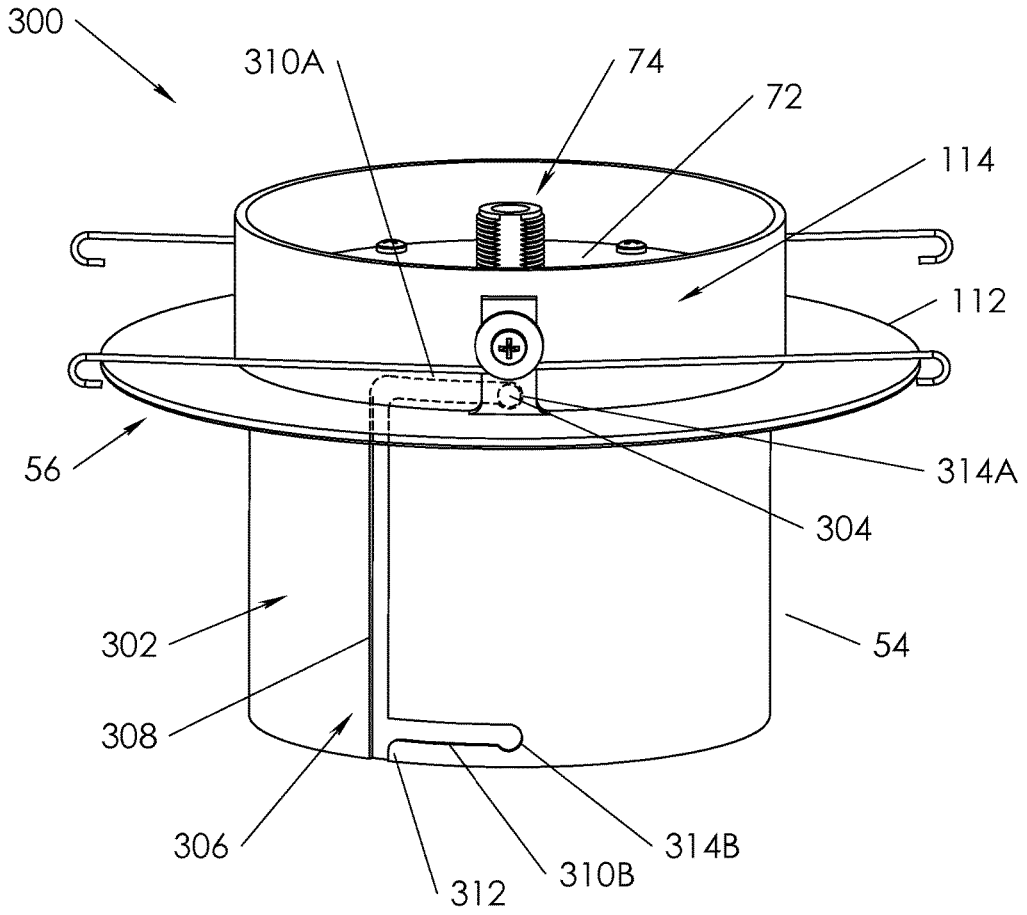

With reference to FIGS. 7A-7B, a third embodiment of an adjustable in-building antenna structure 300 (hereinafter "antenna structure 300") that allows the radome 54 and antenna 52 to be positioned at the two extreme positions but not at any position between the two extreme positions is described. The antenna structure 300 is substantially identical with the antenna structure 50 with the exception of the adjustment structure. The antenna structure 300 includes an adjustment structure 302 in the form of a bayonet connector with a pin 304 that extends above the interior surface of the conduit 110 and engages a slot 306 associated with the exterior surface of the radome 54. The slot 306 has a C-like shape with an upright section 308, first transverse section 310A that adjoins the upright section 308, and a second transverse section 310B that adjoins the upright section 308 and is substantially parallel to the first transverse section 310A. A sub-section 312 of the upright section extends to the first end 96 of the radome 54 to allow the pin 304 to enter the slot 306. Pin seats 314A, 314B respectively located at the ends of the first and second transverse sections 310A, 301B. The interaction of the pin 304 with the first transverse section 310A of the slot 306 serves as a hard stop that defines the second extreme. As such, the antenna structure 300 has no need for the hard stop structure of the shoulder 154 and lip 156 described with respect to antenna structure 50. The interaction of the pin 304 with the second transverse section 310B of the slot 306 defines the first extreme, i.e., the position of the radome 54 relative to the flange 112 at which the end member 96 of the radome 54 is conformal with the outer planar surface 122 of the flange 112. It should be appreciated that the locations of the pin 304 and the slot 306 can be reversed, i.e., the pin can extend above the exterior surface of the radome 54 and a slot can be established in or associated with a conduit.

Figure 8A:
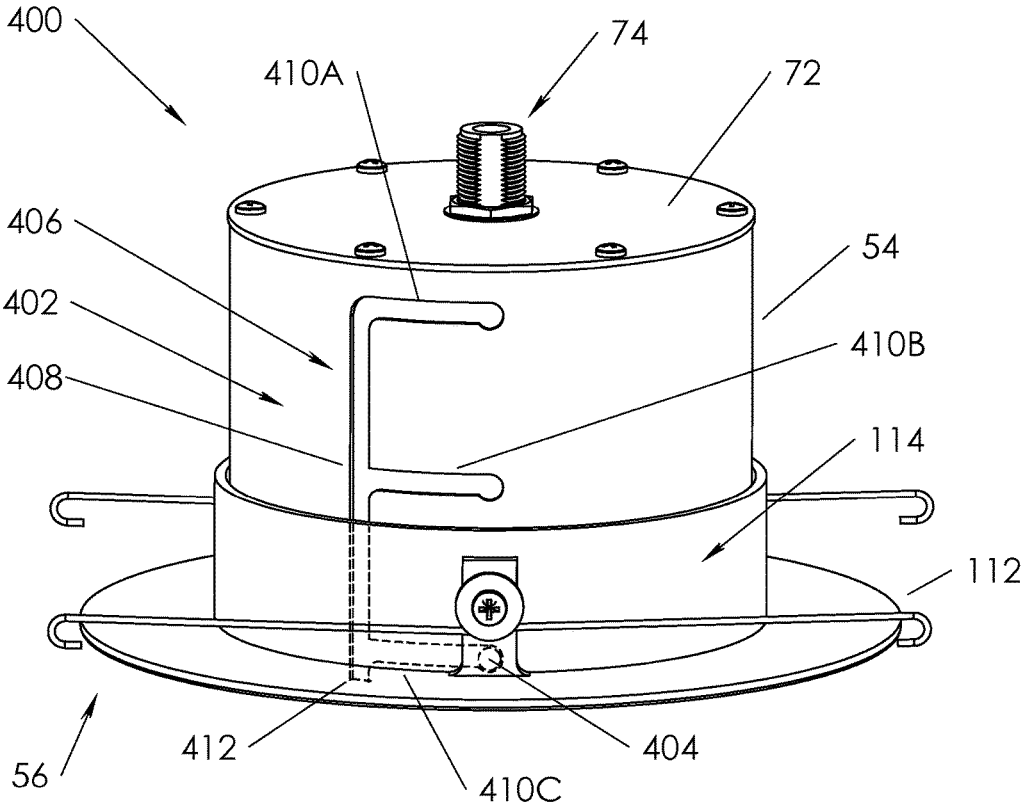
FIGS. 8A-8C illustrates a fourth embodiment of an adjustable in-building antenna system with a bayonet adjustment system that allows the position of the radome to be adjusted such that the end surface of the radome is positioned at three discrete locations, namely, at: (a) a first extreme characterized by the end surface being substantially conformal to the a flange and (b) a second extreme characterized by the end surface being spaced from the flange and (c) any location between the two extremes.
Figure 8B:
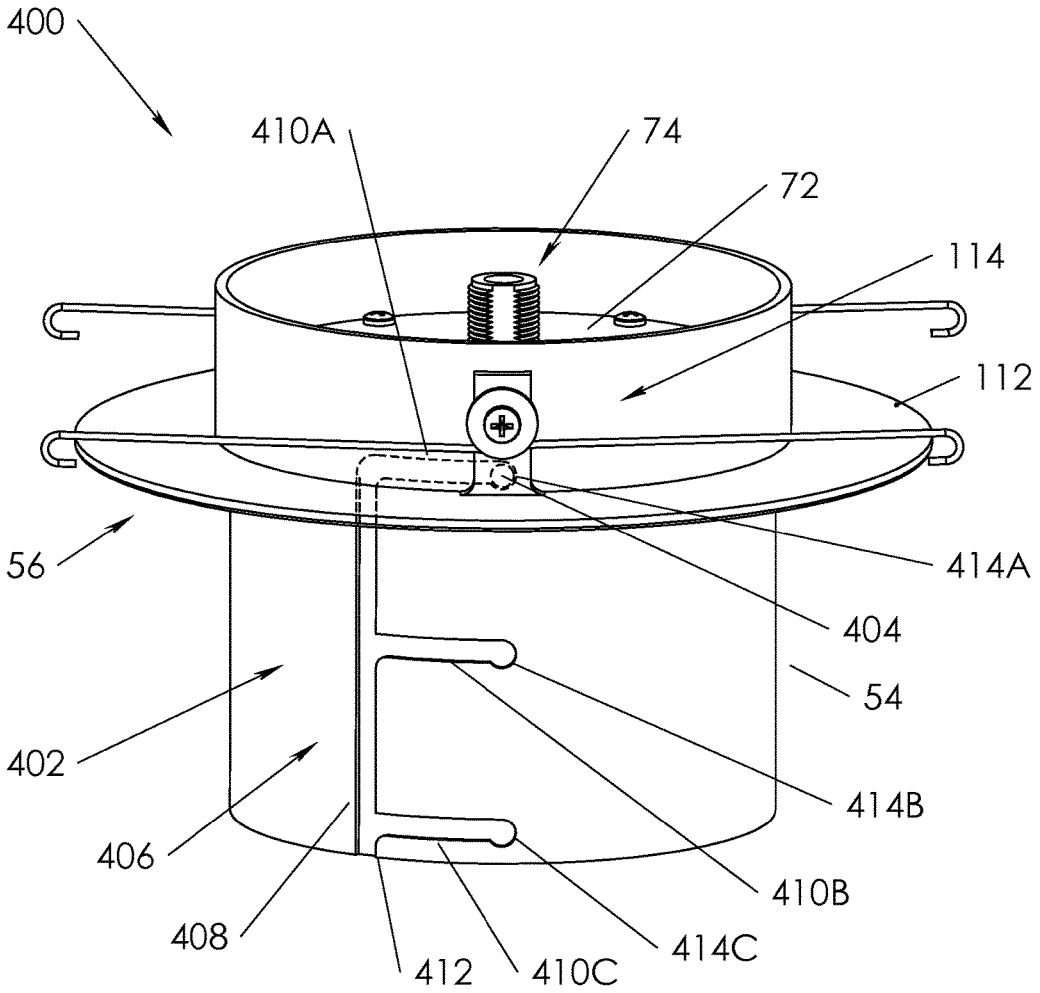
Figure 8C:
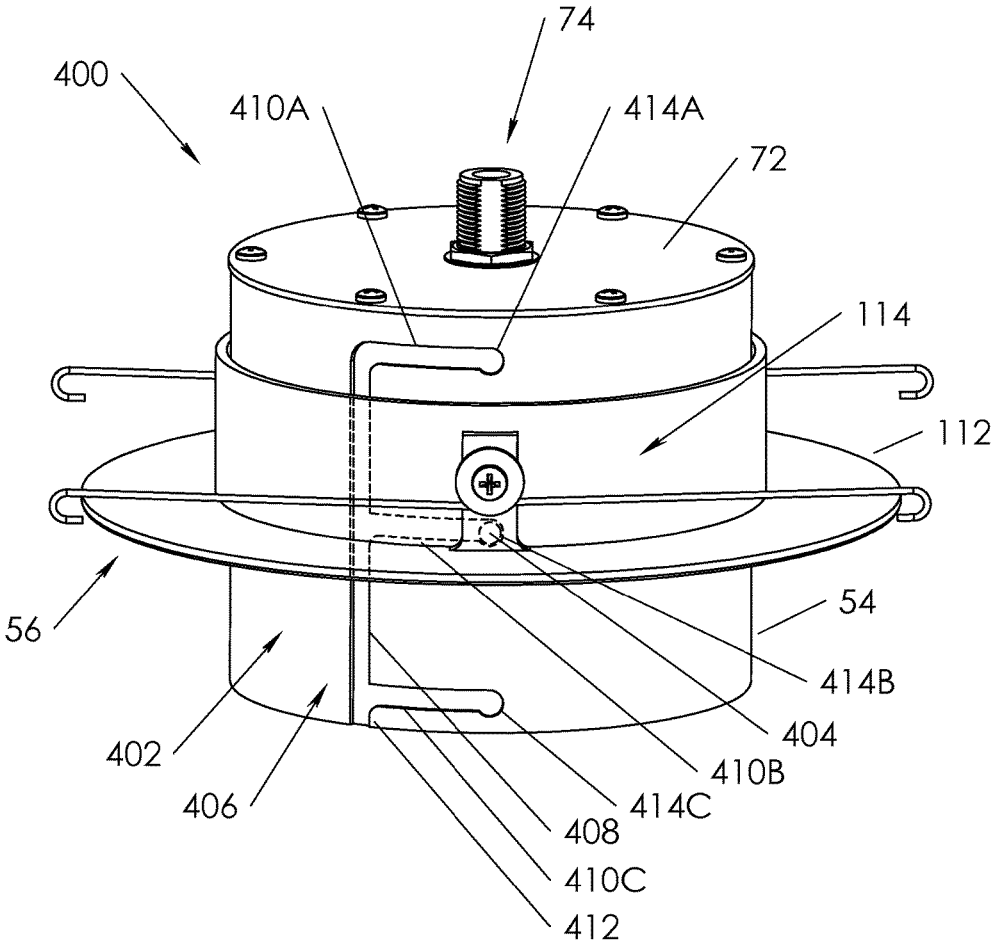

With reference to FIGS. 8A-8C, a fourth embodiment of an adjustable in-building antenna structure 400 (hereinafter "antenna structure 400") that allows the radome 54 and antenna 52 to be positioned at the two extreme positions and at one discrete position between the two extreme positions is described. The antenna structure 400 is substantially identical with the antenna structure 50 with the exception of the adjustment structure. The antenna structure 400 includes an adjustment structure 402 in the form of a bayonet connector with a pin 404 that extends above the interior surface of the conduit 110 and engages a slot 406 associated with the exterior surface of the radome 54. The slot 406 has a E-like shape with an upright section 408, first transverse section 410A that adjoins the upright section 308, and a second transverse section 410B that adjoins the upright section 408 and is substantially parallel to the first transverse section 410A, and a third transverse section 410C that adjoins the upright section 408 and is substantially parallel to the first transverse section 410A. A sub-section 412 of the upright section extends to the first end 96 of the radome 54 to allow the pin 404 to enter the slot 406. Pin seats 414A-414C respectively located at the ends of the first, second, and third transverse sections 410A-410C. The interaction of the pin 404 with the first transverse section 410A of the slot 406 serves as a hard stop that defines the second extreme. As such, the antenna structure 400 has no need for the hard stop structure of the shoulder 154 and lip 156 described with respect to antenna structure 50. The interaction of the pin 404 with the third transverse section 410C of the slot 406 defines the first extreme, i.e., the position of the radome 54 relative to the flange 112 at which the end member 96 of the radome 54 is conformal with the outer planar surface 122 of the flange 112. The interaction of the pin 404 with the second transverse section 410B of the slot 406 allows the radome 54 to be positioned at a discrete position between the two extreme positions. If the ability to position the radome 54 at additional discrete locations between the two extreme positions is needed or desired, the slot 406 can be modified to include addition transverse sections. It should be appreciated that the locations of the pin 404 and the slot 406 can be reversed, i.e., the pin can extend above the exterior surface of the radome 54 and a slot can be established in or associated with a conduit.

Figure 4:
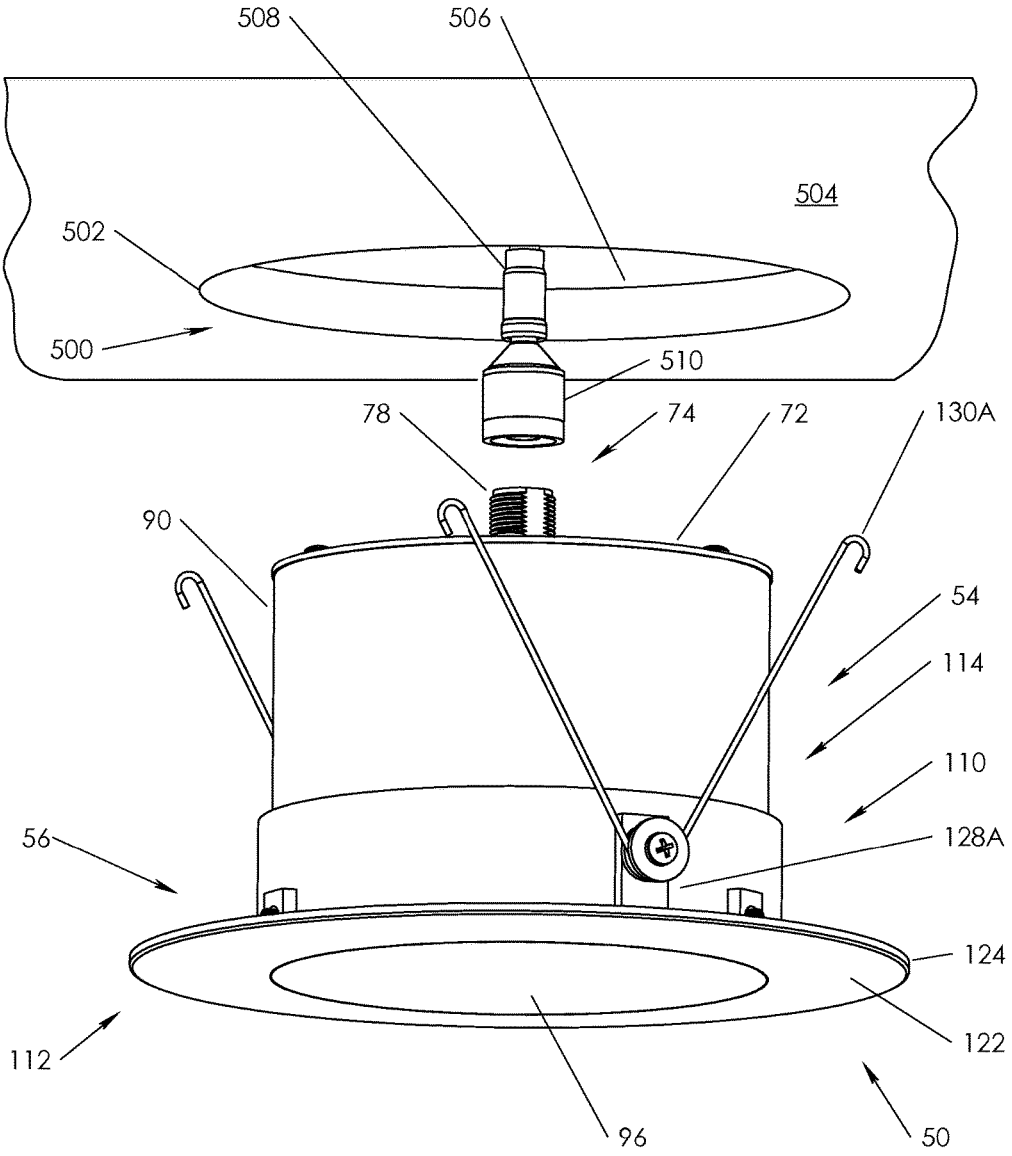
FIG. 4 is a perspective view of the first embodiment of the adjustable in-building antenna structure shown in FIGS. 1A-1B being associated with an interior building structure.
Figure 5A:
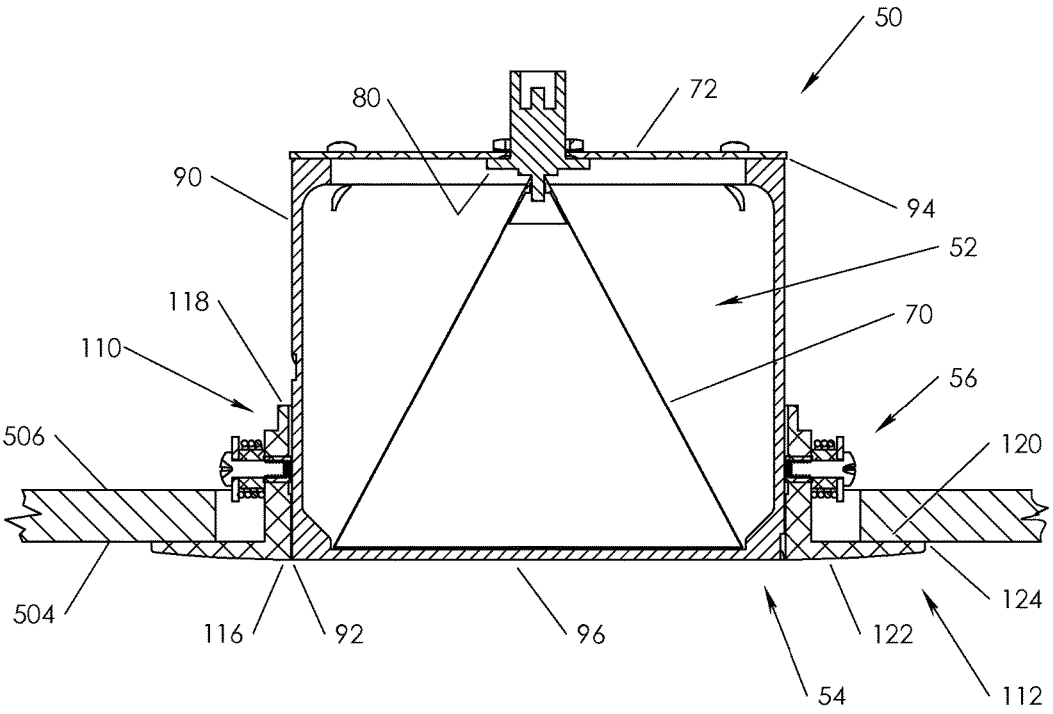
FIGS. 5A-5B respectively are cross-sectional views of the first embodiment of the adjustable in-building antenna structure shown in FIGS. 1A-1B associated with an interior building structure and with the end surface of the radome substantially conformal with the surface of the flange and the end surface of the radome spaced from the flange.
Figure 5B:
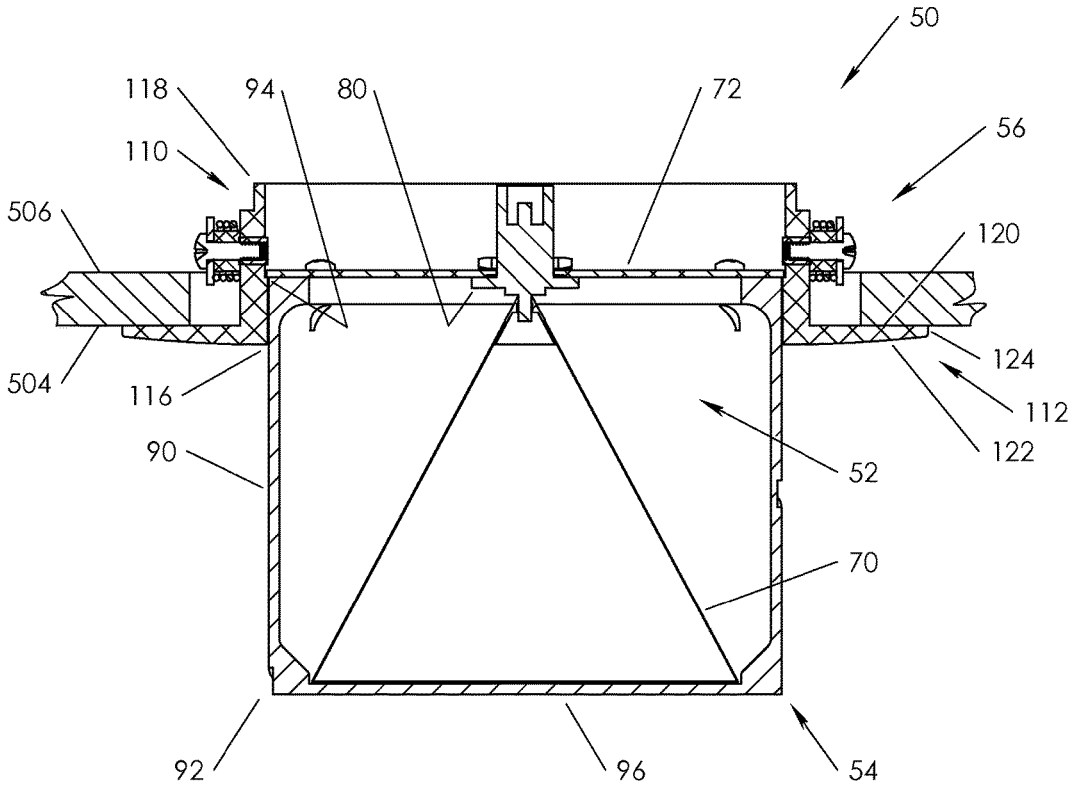

With reference to FIGS. 4, 5A, and 5B, installation of the antenna structure 50 includes establishing a hole 500 in an interior building structure 502 that has room-side surface 504 and a plenum-side surface 506. The room-side surface 504 defines at least a portion of the room-side space in the building in which the antenna structure 50 is to operate. The plenum-side surface 506 defines at least a portion of an enclosed plenum-side space that contains a coaxial cable 508 with a connector 510 capable of operatively engaging the connector 74 of the antenna structure 50. The coaxial cable 508 is or will be connected to the transmitter/receiver with which the antenna structure 50 is meant to operate. The hole 500 is of sufficient size and dimension to receive the conduit 110, the securing structure 114, and the adjustment structure 58. However, the hole 500 is not of sufficient size to receive the flange 112.

Before the antenna structure 50 is mounted to the interior building structure 500, coaxial cable 508 and connector 510 are typically tested to determine if the cable and connector are capable of conveying a signal. Assuming that the coaxial cable 508 and connector 510 are capable of conveying a signal, any problems in transmitting a signal to or receiving a signal from the antenna structure 50 are likely to be associated with the antenna structure 50. Also before the antenna structure 50 is mounted the interior building structure 500, the first and second arms 136A, 138A associated with the torsion spring 130A and the first and second arms 136B, 138B associated with the torsion spring 130B are flexed away from the flange 112 so that the arms can be received by the hole 500. Further, the connector 74 of the antenna structure 50 and the connector 508 of the coaxial cable 506 are connected to one another. Additionally, the adjustment structure 58 is typically used to adjust the position of the end member 96 of the radome 54 relative to the flange 112 before the antenna structure 50 is inserted in the hole 500. If the plenum-side space is accessible, connection of the antenna structure 50 to the connector 508 of the coaxial cable and/or adjustment of the position of the end member 96 relative to the flange 112 can be done after the antenna structure 50 is mounted to the interior building structure 500. Typically, the set screws 152A-152C of the adjustment structure 58 are used to establish the initial position of the end member 96 such that the end member 96 is conformal with the outer planar surface 122 of the flange 112, i.e., at the first extreme. However, the set screws 152A-152C can be used to establish the position of the end member 96 at the second extreme or at any point between the first and second extremes. In the case of the positioning the end member 96 at the second extreme (i.e., with the end member 96 positioned the maximum distance away from the flange 112), the set screws 152A-152C do not need to engage the exterior surface of the conduit 110, at least when the antenna structure 50 is being mounted to a ceiling-like structure (e.g., a ceiling tile). Rather, this position can be established by allowing the lip 156 to engage the shoulder 154.

After the first and second arms 136A, 138A associated with the torsion spring 130A and the first and second arms 136B, 138B associated with the torsion spring 130B are flexed away from the flange 112 so that the arms can be received by the hole 500, the portion of the antenna structure 50 on the inner planar surface side of the flange 112 is inserted into the hole 500. Thereafter, the first and second arms 136A, 138A associated with the torsion spring 130A and the first and second arms 136B, 138B associated with the torsion spring 130B attempt to return to the positions shown in FIGS. 1A-1B. However, the building structure 502 typically is of a thickness that prevents the arms from returning to these positions and result in the securing surfaces 140A, 142A associated with the torsion spring 130A and the securing surfaces 140B, 142B associated with the torsion spring 130B engage and apply forces to the plenum-side surface 506 of the interior building structure 502. These spring forces and an opposing force applied to the interior building structure 502 by the flange 112 result in the antenna structure 50 being fixed to the interior building structure 502.

After the antenna structure 50 is fixed to the interior building structure 502, the antenna structure 50 is tested to determine if the antenna structure 50 is capable of conveying a signal to and from a device (e.g., cell phone, computer, etc.) located within the interior environment at least partially defined by room-side surface 504 of the interior building structure 502. Typically, this testing is repeated at several different locations within which interior environment that the antenna structure 50 is meant to service. If the antenna structure 50 fails to convey a signal to and/or from such a device, there are at least two possible explanations for the failure. Specifically, there is (a) a multi-path issue and/or (b) there is a significant metal content in the building structure 502 to which the antenna structure 50 is mounted or significant metal content in a structure adjacent to where the antenna structure is located. With respect to both of these possible explanations for the failure of the antenna structure 50 to operate as needed, a possible solution that may avoid having to relocate the antenna structure and/or employ additional antennas in the interior environment is to change the position of the radome 54 and monocone antenna 52 relative to the flange 112. This change in position is accomplished by accessing and using the adjustment structure 58 to change the position of the radome 54 and monocone antenna 52 relative to the flange 112. The testing is then repeated to determine whether the change in position has addressed the potential sources of the inadequate operation of the antenna structure 50. Due to the adjustment structure 58 allowing the radome 54 and monocone antenna 52 to be positioned relative to the flange 112 at either of the two extremes and any location between the two extremes, the testing and adjustment of the antenna structure 50 can be repeating a number of times. Typically, any repeating and adjustment is done in a methodical pattern that avoids multiple tests of the operation of the antenna structure 50 with the radome 54 and monocone antenna 52 at the same location relative to the flange 112. If one or more positions of the radome 54 and monocone 52 are determined to result in adequate operation of the antenna structure 50 and one or more of these positions is otherwise acceptable to the user, the testing of the antenna structure 50 can be terminated. If, on the other hand, the testing or repeated testing do not result in one or more positions of the radome 54 and monocone 52 antenna providing satisfactory operation and/or are not satisfactory to the user from an aesthetic perspective, other options can be investigated. For example, other potential causes of inadequate operation, relocation of the antenna structure 50, and/or the use of an additional antenna structure to service the target interior environment can be investigated.

With respect to the adjustable in-building antenna structure 200, the installation and testing of the antenna structure is substantially identical to that of antenna structure 50. However, if repositioning of the radome 54 and monocone antenna 52 relative to the flange 112 is needed or desirable, the adjustment structure 202 allows the repositioning to be done from the room-side. Since the antenna structure 200 allows the radome 54 and monocone antenna 52 to be positioned at either of the extreme positions and at any position between the two extreme positions, repositioning and testing can be repeated for a large number of positions of the radome 54 and monocone 52 relative to the flange 112.

With respect to the adjustable in-building antenna structure 300, the installation and testing of the antenna structure is substantially identical to that of antenna structure 50. However, the adjustment structure 302 limits the positions that radome 54 and monocone antenna 52 can take with respect to the flange 112 to two discrete positions, namely, the two extreme positions. The adjustment structure 302 allows the repositioning to be accomplished from the room-side.

With respect to the adjustable in-building antenna structure 400, the installation and testing of the antenna structure is substantially identical to that of antenna structure 50. However, the adjustment structure 402 limits the positions that radome 54 and monocone antenna 52 can take with respect to the flange 112 to three discrete positions, namely, the two extreme positions and one position between the two extreme positions. The adjustment structure 402 allows any repositioning to be accomplished from the room-side.

Subsequent to the installation of the antenna structure 50 and the acceptable operation of the antenna structure 50 within the interior environment, the antenna structure 50 may begin to provide unacceptable operation. Two potential causes of the unacceptable operation including multi-path phenomena and some object with a significant metallic content being positioned adjacent to the antenna structure 50. To address these potential causes of the unacceptable operation, the adjustment structure 58 is used to change the position of the radome 54 and monocone antenna 52 relative to the flange 112 and testing is repeated. Since the antenna structure 50 allows the radome 54 and monocone antenna 52 to be positioned relative to the flange 112 at the two extreme positions and any position between the two extreme positions, the repositioning and testing can be repeated a large number of times. If one or more positions of the radome 54 and monocone 52 are determined to result in adequate operation of the antenna structure 50 and one or more of these positions is otherwise acceptable to the user, the testing of the antenna structure 50 can be terminated. If, on the other hand, the testing or repeated testing do not result in one or more positions of the radome 54 and monocone 52 antenna providing satisfactory operation and/or are not satisfactory to the user from an aesthetic perspective, other options can be investigated.

With respect to the second, third, and fourth embodiments of an adjustable in-building antenna structure 200, 300, and 400, the repositioning of the radome 54 and monocone antenna 52 and testing can be done according to the particular limitations of the relevant adjustment structure. If one or more positions of the radome 54 and monocone 52 are determined to result in adequate operation of the antenna structure 50 and one or more of these positions is otherwise acceptable to the user, the testing of the antenna structure 50 can be terminated. If, on the other hand, the testing or repeated testing do not result in one or more positions of the radome 54 and monocone 52 antenna providing satisfactory operation and/or are not satisfactory to the user from an aesthetic perspective, other options can be investigated.

The foregoing description of the invention is intended to explain the best mode known of practicing the invention and to enable others skilled in the art to utilize the invention in various embodiments and with the various modifications required by their particular applications or uses of the invention.

What is claimed is:

1. An adjustable antenna structure for in-building use, the adjustable antenna structure comprising:

an antenna comprising a radiator and an antenna connector for engaging a cable connector associated with a cable for use in transmitting and/or receiving electrical signals to/from the radiator;

a radome for substantially surrounding and supporting the radiator of the antenna, the radome comprising a sleeve with a first end, a second end, and an end surface extending across the first end of the sleeve;

a mount comprising:

a conduit that defines an opening for receiving the radome;

a flange, operatively connected to the conduit, for disposing adjacent to the exterior surface of an interior building structure, and a securing structure with a securing surface that can be positioned to accommodate a portion of an interior building structure between the securing surface and the flange to secure the mount to the interior building structure and to establish the flange substantially adjacent to the exterior surface of the interior building structure; and an adjustment structure for adjustably establishing the position of the radome relative to the flange;

wherein, when the radome is positioned in the opening defined by the conduit, the adjustment structure can be used in adjusting the position of the radome relative to the mount between at least: (a) a first position in which the end surface of the radome is substantially conformal with the flange and (b) a second position in which the end surface of the radome is spaced from the flange.

2. An adjustable antenna structure, as claimed in claim 1, wherein:

the adjustment structure can be used to adjust the position of the radome relative to the flange to a third position in which the end surface of the radome is located between the first and second positions.

3. An adjustable antenna structure, as claimed in claim 2, wherein:

the adjustment structure comprises a set screw with an end capable of operatively engaging the radome at a number of different locations on the radome.

4. An adjustable antenna structure, as claimed in claim 2, wherein:

the adjustment structure comprises a pair of matable threads, one of the matable threads associated with the conduit and the other of the matable threads associated with the radome.

5. An adjustable antenna structure, as claimed in claim 2, wherein:

the adjustment structure comprises a bayonet connector that includes a pin associated with one of the mount and the radome and a structure defining a slot for engaging the pin associated with the other of the mount and the radome, wherein the slot has a main slot and at least three side slots adjoining the main slot.

6. An adjustable antenna structure, as claimed in claim 1, wherein:

the adjustment structure comprises a bayonet connector that includes a pin associated with one of the mount and the radome and a structure defining a slot for engaging the pin associated with the other of the mount and the radome, wherein the slot has a main slot and two side slots adjoining the main slot.

7. An adjustable antenna structure, as claimed in claim 1, wherein:

the antenna comprises a ground plane that is operatively disposed relative to the radiator.

8. An adjustable antenna structure, as claimed in claim 7 wherein:

the ground plane extends across the second end of the sleeve.

9. An adjustable antenna structure, as claimed in claim 1, wherein:

the securing structure includes a torsion spring.

10. An adjustable antenna structure, as claimed in claim 1, wherein:

when the radome is in the second position, a portion of at least one of the antenna and the radome engages the mount to prevent further movement of the radome in the direction going from the first position to the second position.

11. A method for establishing a functional, adjustable antenna structure within a hole in an interior building structure comprising:

providing an adjustable antenna structure as set forth in claim 1;

establishing a hole in the interior building structure of sufficient dimensions to receive the radome and allow the flange to be positioned adjacent to a portion of the interior building structure;

connecting a cable connector located in a hollow space behind the interior building structure to the antenna connector;

manipulating the securing structure to dispose a portion of the interior building structure between the securing surface and the flange to secure the mount to the interior building structure and to fix the position of the flange substantially adjacent to the exterior surface of the interior building structure;

disposing, if needed, the radome in the opening defined by the conduit;

employing, if needed, the adjustment structure to establish one of the first position of the radome relative to the flange and the second position of the radome relative to the flange;

first determining, after completion of the foregoing steps, whether the antenna is sufficiently operational; and first using, after the step of first determining and if the antenna is not sufficiently operational, the adjustment structure to establish the other of the first position of the radome relative to the flange and the second position of the radome relative to the flange.

12. A method, as claimed in claim 11, wherein:

the step of employing establishes the first position of the radome relative to the flange.

13. A method, as claimed in claim 11, further comprising:

first defining whatever position the radome is in relative to the flange as the current position;

second determining, after the step of first using, whether the antenna is sufficiently operational;

second defining, after the step of second determining and if the antenna is not sufficiently operational, the current position of the radome relative to the flange to be a prior position of the radome relative to the flange;

second using, after the steps of second determining and defining and if the antenna is not sufficiently operational, the adjustment structure to establish a new position of the radome relative to the flange operation that is different than a prior position of the radome relative to the flange.

14. A method, as claimed in claim 13, further comprising:

repeating the steps of first defining, second determining, second defining, and second using until the step of second determining determines that the antenna is sufficiently operational.

15. A method, as claimed in claim 13, wherein:

the new position is a position other than any prior position.

16. A method for adjusting an adjustable antenna structure mounted in a hole associated with an interior building structure comprising:

having an adjustable antenna structure as set forth in claim 1 that is: (a) established in a hole associated with an interior building structure, (b) connected to a cable connector associated with a cable capable of transmitting and/or receiving electrical signals to/from the radiator, and (c) has the radome in a current position relative to the flange;

experiencing a situation in which the antenna may not be sufficiently operational;

first using the adjustment structure to change the position of the radome relative to the flange from a current position to a new position that is different than the current position.

17. A method, as claimed in claim 16, wherein:

the current position is one of: the first position of the radome relative to the flange and the second position of the radome relative to the flange;

the new position is the other of: the first position of the radome relative to the flange and the second position of the radome relative to the flange.

18. A method, as claimed in claim 16, wherein:

defining, after the step of first using or the step of second using, the current position as a prior position and the new position as the current position;

determining, after completion of the foregoing steps, whether the antenna is sufficiently operational; and second using, after the step of determining and if the antenna is not sufficiently operational, the adjustment structure to establish a new position of the radome relative to the flange that is different than the current position and any prior position of the radome relative to the flange.

19. A method, as claimed in claim 18, further comprising:

repeating the steps of defining, determining, and second using until the step of determining determines that the antenna is sufficiently operational.

* * * * *